US006816439B1

(12) United States Patent
Kawahara et al.

(10) Patent No.: US 6,816,439 B1
(45) Date of Patent: Nov. 9, 2004

(54) RECHARGEABLE ELECTRONIC WATCH AND DRIVING METHOD OF RECHARGEABLE ELECTRONIC WATCH

(75) Inventors: Hisashi Kawahara, Tokyo (JP); Haruhiko Higuchi, Tokyo (JP)

(73) Assignee: Citizen Watch Co., Ltd., Tokyo (JP)

( * ) Notice: Subject to any disclaimer, the term of this patent is extended or adjusted under 35 U.S.C. 154(b) by 253 days.

(21) Appl. No.: 09/718,614

(22) Filed: Nov. 22, 2000

(30) Foreign Application Priority Data

Nov. 24, 1999 (JP) ..... 11-333051

(51) Int. Cl.[7] ..... G04B 1/00
(52) U.S. Cl. ..... 368/64; 368/66; 368/204
(58) Field of Search ..... 368/64, 66, 203–205

(56) References Cited

U.S. PATENT DOCUMENTS 4,041,691 A * 8/1977 Chihara et al.
4,219,999 A * 9/1980 Ichikawa et al. ..... 368/66
4,702,613 A * 10/1987 Ohtawa ..... 368/66
4,759,003 A * 7/1988 Kiyono et al. ..... 368/66
5,886,953 A * 3/1999 Kawahara et al. ..... 368/66
5,889,736 A * 3/1999 Fujita et al. ..... 368/66
6,061,304 A * 5/2000 Nagata et al. ..... 368/66
6,459,658 B1 * 10/2002 Fujita et al. ..... 368/203

FOREIGN PATENT DOCUMENTS

EP 0855633 7/1998
EP 0952500 10/1999

* cited by examiner

*Primary Examiner*—Vit W. Miska
(74) *Attorney, Agent, or Firm*—Scully, Scott, Murphy & Presser

(57) ABSTRACT

To extend the clock operation duration of a multi-functional rechargeable electronic watch, and to provide a rechargeable electronic watch that would not affect the feeling of use of said rechargeable electronic watch. A rechargeable electronic watch (10) operating with an energy source comprising a power supply (26) including a power generation means (1) and a power storage means (2) charged with electric energy from said power generation means (1), said rechargeable electronic watch comprising a watch circuit (5) for counting or operating hour information or function information or the like and outputting information, a display means (11) for displaying hour information or function information or the like based on output signal from said watch circuit, a power generation magnitude detecting means (3) for detecting the power generation volume of said power generation means (1), and a control means (5) for controlling the operation of said watch circuit (5) according to said power generation magnitude, wherein said watch circuit (5) is driven by at least one clock operation mode selected from a plurality of clock operation modes different in power consumption provided by said watch circuit (5).

13 Claims, 5 Drawing Sheets

RECHARGEABLE ELECTRONIC WATCH AND DRIVING METHOD OF RECHARGEABLE ELECTRONIC WATCH

BACKGROUND OF THE INVENTION

1. Field of the Invention

The present invention is related to a rechargeable electronic watch and a driving method of the rechargeable electronic watch, and more particularly, a rechargeable electronic watch of which the clock operation duration can be prolonged and a driving method of the same.

2. Description of the Related Art

Conventionally, some electronic watches are provided with an additional power saving mode function for reducing the power consumption of the electronic watch provided that it would not hinder particularly the use of the electronic watch for the purpose of using as long as possible the power supply means compose of a storage battery or the like used at the same time as a power generation means.

For instance, as disclosed in the Japanese Unexamined Patent Publication (KOKAI) No. 5-60075, an electronic watch using a solar cell as a main power source enters the power save mode when there is no sunlight incident on the solar cell of the electronic watch continuously for a predetermined fixed time, and exits the power saving mode when there is sunlight incident on the solar cell again.

Also, the power saving mode function in such a conventional electronic watch is designed to enter the power saving mode for stopping all hour display and stop driving of the display means including hour information display in a state disadvantageous for the power source, for instance, when a solar cell is used as a power source, because it is essential to use the power source as long as possible.

However, in recent years, an analog electronic watch whose hour and minute hands and second hand are driven by separate motors for time display, or a combination electronic watch wherein the seconds are displayed by a liquid crystal display are also made for practical use, and if all hour display is stopped under a certain condition, the user could not obtain any information at all.

On the other hand, electronic watches provided with a built-in display mechanism of several kinds of functions including a chronometer display function, alarm display function, atmospheric pressure display function, water depth display function or the like are also made for practical use, and are designed to display on a predetermined display means the kind or kinds of function information at the same time as the hour information, or changing over with the hour information.

In such recent electronic watches implementing function information other than hour information, if a conventional type power saving mode function is used, not only the hour information but also function information are not displayed at the same time on the display means, when a state disadvantageous for the power source as mentioned above happens, blocking the use of the function information display means, particularly in an environment requiring function information, causing to reduce the product value as a multi-functional electronic watch.

On the other hand, Japanese Unexamined Patent Publication (KOKAI) No. 9-304555 discloses a rechargeable electronic watch wherein a counter is installed for measuring the elapsed time after the motor stops, to facilitate a return to an accurate actual hour even when the hand motion is stopped for power saving, and for measuring rapid advance time also, to return hour and minute hands to the accurate actual time from both measured times.

However, in the Publication, the motion of the hour and minute hands stops only when the output from the power generation means or power storage means of the rechargeable electronic watch becomes equal or below a predetermined level, namely, only under a certain fixed condition; therefore, in a rechargeable electronic watch provided with a plurality of additional functions, the additional functions become completely unavailable, even when the voltage state allows the use of the additional functions, causing the user inconvenience.

SUMMARY OF THE INVENTION

Therefore, an object of the present invention is to improve the aforementioned defects of the prior art and to provide an electronic watch in that in displaying clock information and function information on separate display means, respectively, for example, by hands and by a liquid crystal display, the electronic watch can be selectively controlled under the most optimal clock operation mode selected from a plurality of clock operation modes by selecting an arbitrary circuit or by using a display means whereby the display means can be stopped, in response to an amount of power generation in a power generator or an amount of power storage flowing into a power storing means, in a power saving mode.

A further object of the present invention is to provide a rechargeable electronic watch among multi-functional rechargeable electronic watches providing a number of additional function information, which does not lose complete usage of the rechargeable electronic watch by forming the electronic watch so that one of the functions of the rechargeable electronic watch can be selected arbitrarily in response to either an amount of power generation in a power generator or an amount of power storage flowing into_a power storing means so as to optimize a balance of the power, which is the same as that in an electronic watch only displaying time information, whereby it is intended to extend a clock operation duration of the rechargeable electronic watch as well as to keep limitations for using a certain function a user of the watch wishes to use at the lowest level.

In order to attain the above-mentioned objects of the present invention, the present invention basically has the technical construction as mentioned hereunder.

Note that, a first aspect of the present invention is a rechargeable electronic watch operating with an energy source comprising a power supply including a power generation means and a power storage means charged with electric energy generated from the power generation means, the rechargeable electronic watch comprising a watch circuit for counting or processing time information or function information or the like so as to output the information, a display means for displaying the time information or the function information or the like based on an output signal from the watch circuit, a power generation amount detecting means for detecting the amount of power generation of the power generation means, and a control means for controlling the operation of the watch circuit in response to the amount of the power generation , wherein the watch circuit is driven in at least one clock operation mode selected, based on the control of the control means, from a plurality of clock operation modes provided in the rechargeable electronic watch, with each of the modes being different from each other in power consumption.

A second aspect of the present invention is a rechargeable electronic watch operating with an energy source comprising a power supply including a power generation means and a power storage means charged with electric energy generated from the power generation means, the rechargeable electronic watch comprising a watch circuit for counting or processing time information or function information or the like so as to output the information, a display means for displaying the time information or the function information or the like based on an output signal from the watch circuit, a power storage amount detecting means for detecting the amount of power storage flowing into in the power storage means, and a control means for controlling the operation of the watch circuit in response to the amount of the power_ storage, wherein the watch circuit is driven in at least one clock operation mode selected, based on the control of the control means, from a plurality of clock operation modes provided in the rechargeable electronic watch, with each of the modes being different from each other in power consumption.

A third aspect of the present invention is a rechargeable electronic watch operating with an energy source comprising a power supply including a power generation means and a power storage means charged with electric energy generated from the power generation means, there chargeable electronic watch comprising a watch circuit for counting or processing time information or function information or the like so as to output the information, a display means for displaying the time information or the function information or the like based on an output signal from the watch circuit, a power generation amount detecting means for detecting the amount of power generation of the power generation means, a power storage amount detecting means for detecting the amount of power storage flowing into the power storage means, a remaining capacity detecting means for detecting the remaining capacity of the power storage means and a control means for controlling the operation of the watch circuit in response to the two optional detected values selected among three detected values, such as the power generation amount, the power storage amount and the remaining capacity, wherein the watch circuit is driven in at least one clock operation mode selected, based on the control of the control means, from a plurality of clock operation modes provided in the rechargeable electronic watch, with each of the modes being different from each other in power consumption.

DETAILED DESCRIPTION OF THE PREFERRED EMBODIMENTS

Now, specific examples of rechargeable electronic watches and driving methods of rechargeable electronic watches of the present invention will be described in detail referring to drawings.

Figure 1:
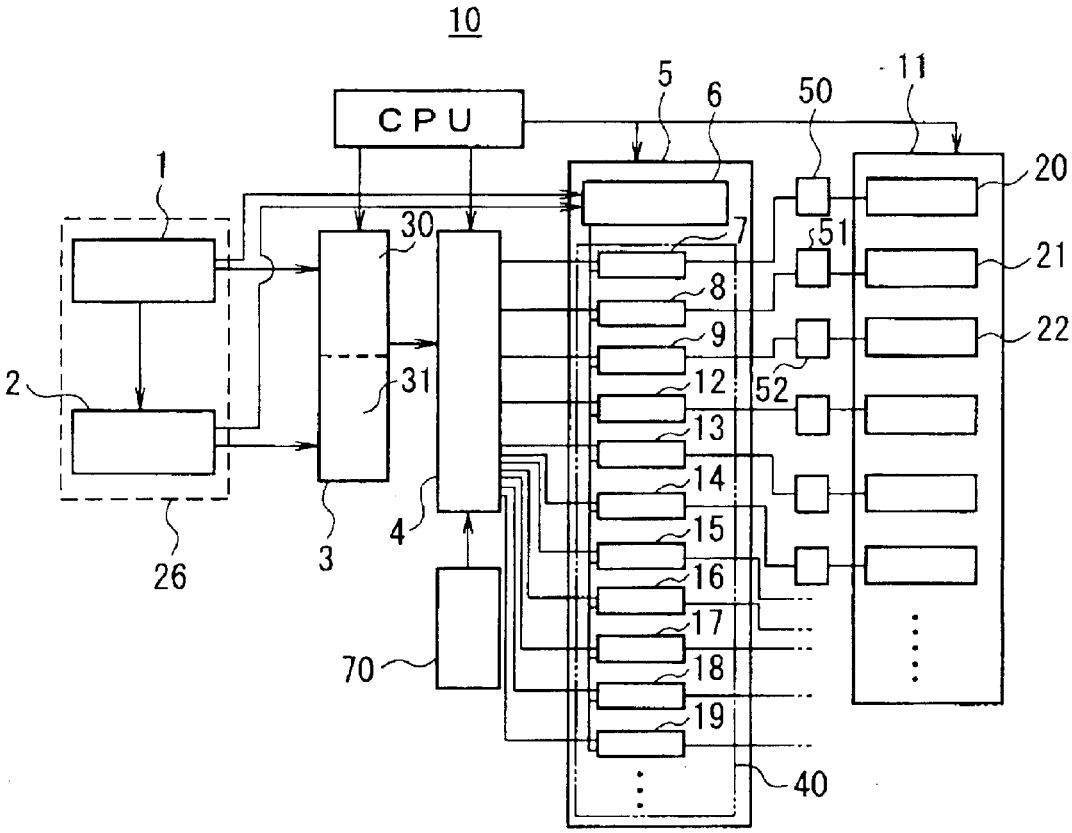
FIG. 1 is a block diagram showing the composition of one exemplary embodiment of the rechargeable electronic watch of the present invention.

Namely, FIG. 1 is a block diagram illustrating the composition of one exemplary embodiment of a rechargeable electronic watch 10 according to the present invention, and in the drawing, a rechargeable electronic watch 10 operating with an energy source comprising a power supply 26 including a power generation means 1 and a power storage means 2 charged with electric energy from the power generation means 1, the rechargeable electronic watch 10 comprising a watch circuit 5 for counting or processing time information or function information or the like and outputting information, a display means 11 for displaying time information or function information or the like based on output signal from the watch circuit, an amount of power generation detecting means 3 for detecting the power generation amount of the power generation means 1, and a control means 4 for controlling the operation of the watch circuit 5 in response to the power generation amount, wherein said watch circuit 5 is driven in at least one clock operation mode selected, based on the control of said control means, from a plurality of clock operation modes provided in said rechargeable electronic watch, with each of the modes being different from each other in power consumption.

In other words, FIG. 1 is a block diagram of essential parts of one rechargeable electronic watch 10 according to the present invention, and the power generation means 1 composing the power supply 26 is not particularly limited in its composition, but it may be a solar cell, self-winding type power generator for generating power in response to the motion, including arm motion, thermal power generator for generating power using differential temperature, or those using spring drive power generation or the like.

In addition, the power storage means 2 in the present invention is not particularly limited in its composition; however, for instance, a rechargeable secondary battery can be employed.

On the other hand, besides the means 30 for detecting the amount of power generation of the power generation means, the power generation amount detecting means 3 may include a power storage amount detecting means 31 for detecting the power storage amount (power flowing into)-the power storage means 2.

The power generation amount detecting means 3 of the present invention can detect, for instance, voltage or current output from the power generation means 1 or the power storage means 2, in addition to detecting an amount of the power generation, or detecting an amount of the power storage.

Next, the control means used in the present invention has a function to select a clock operation mode which is the most appropriate for the concerned object, while considering the conditions of the power generation amount of the power generation means 1 detected by the power generation amount detecting means 3 or the remaining capacity stored in the power storage means 2. Processing is performed by determining whether or not the degree of the power generation amount of the power generation means 1 or the remaining capacity stored in the power storage means 2 at the current period, is at a sufficient level for operating all of the plurality of the watch operation modes provided on the electronic watch circuit 5, or by determining which clock operation mode would preferably be selected or which clock operation mode would be preferably be stopped while taking the power consumption of each one of the clock operation modes into account so as to keep the remaining capacity of the power storage means for as long a time as possible.

The control means 4 has a data master or lookup table 70 for memorizing individually the power consumption amount in each of the aforementioned several kinds of clock operation modes, and selects and controls the optimal state from several kinds of clock operation modes based on the information from the lookup table 70 and the power generation amount detecting means 3.

On the other hand, the watch circuit 5 includes a time circuit 6 for outputting hour information and a clock operation mode setting means 40 for executing the various clock operation modes.

The clock operation mode setting means 40 of the present invention preferably includes at least one of driving operation modes such as, for example, a second hand driving operation mode for driving the second hand, with a second hand driving operation mode setting means 7, a minute and hour hands driving operation mode for driving the minute and hour hands, with a minute and hour hands driving operation mode setting means 8, a liquid crystal display means driving operation mode setting means 9, and further, an alarm function driving operation mode setting means 12, a chronometric function driving operation mode setting means 13, a water depth measuring function driving operation mode setting means 14, a temperature measuring function driving operation mode setting means 15, an altitude measuring function driving operation mode setting means 16, an atmospheric pressure measuring function driving operation mode setting means 17, a radio reception function driving operation mode setting means 18, and a calendar display function driving operation mode setting means 19.

For the aforementioned respective clock operation modes, the power consumption required for executing each driving operation mode is sometimes identical, but is generally different; therefore, electric energy consumption in the power supply 26 is different depending upon which and how many of the several kinds of clock operation modes are selected.

Consequently, when the power generation amount, or the remaining capacity in the power supply 26 is sufficient, all of the respective clock operations modes of the rechargeable electronic watch may be driven; however, when the power generation amount, or the remaining capacity in the power supply 26 is low, the operation is selected to drive only the minimum required clock operation modes based on the power generation amount or the remaining capacity of the power generation means at that actual point of time so as not to detract from the usefulness of the rechargeable electronic watch 10 provided with additional functions, by maintaining the remaining capacity in the power supply 26.

As the power consumption in each respective driving operation mode can be predetermined, it is preferable to store that information in a convenient data base, or in memory in a predetermined format lookup table, and allow the control means 4 to refer to the data base or lookup table.

The display means 11 of the present invention may be any of a digital display or an analog display, and for instance, if the display means 11 is selected as an analog display system, a second hand display 20 and an hour and a minute hand display 21 are provided, and at the same time, the second hand driving operation mode setting means 7 and the hour and minute hand driving operation mode setting means 8 are connected to a second hand motor driving circuit 50 and a hour and minute motor driving circuit 51 respectively.

Besides, in the display means 11 of the present invention, if both the second display 20 and the hour and minute display 21 select a digital display data composed of a digital circuit, both use a crystal liquid display means, and in this case, the second hand motor driving circuit 50 and the hour and minute motor driving circuit 51 are unnecessary.

In addition, if a calendar function is to be used, or other measurement results are to be displayed, they can be displayed by the liquid crystal display 22, and in this case, the liquid crystal display 22 is preferably driven by a convenient liquid crystal liquid driving control circuit 52.

Similarly, in the present invention, if an alarm function or chronometric function are adopted, a digital display is preferably used as the display means corresponding to the respective function, and an analog display may also be used.

As for the display means when the alarm function is to be executed, sound, or light, vibration or other reporting means can be adopted, and sound report means 23, optical report means 24 or vibration report means 25 or the like forth is effect can be installed in the display means 11.

The rechargeable electronic watch 10 of the present invention may also be composed to receive radio electric waves containing hour information, and in this case, it operates to make the time circuit agree with the hour information of the received electric waves, by driving a reception circuit provided in the rechargeable electronic watch 10, at a predetermined timing, and the power consumption at that time is also controlled by the present invention.

In such case, it is not necessary to provide especially the display means 11 with a specific display circuit; however, the reception state of the radio signal containing hour information may be displayed by an optical display means 24 or the like. Now the operation algorithm of the control means 4 used in the present invention will be described.

Note that, the object of the control means 4 in the present invention is to select a clock operation mode for achieving the required power saving operation mode, by determining an amount of the power generation of the power generating means 1 or the remaining capacity of the power storage means 2, both of which constitute the power supply 26 of there chargeable electronic watch 10 and by processing to realize how the power supply 26 can be maintained effective for a long time, or to realize a power saving mode by considering which kind of clock operation mode, among a plurality of clock operation modes, provided in the rechargeable electronic watch 10, should be selected so as to reduce the power consumption of the rechargeable electronic watch 10, in order to display the necessary function information even when the amount of the power generation or the amount of the remaining capacity of the power supply 26 has been reduced.

For instance, the control means 4 detects automatically the condition in which the remaining capacity of the power storage means 2 has become equal to or lower than a predetermined threshold value, or the amount of power generation of the power generation means 1 in the power supply 26 has become equal to or lower than a predetermined threshold value, or the amount of sunlight incident on the solar power generator is equal to or lower than a predetermined threshold value continuously for a predetermined period of time, when the power generation means 1 is a solar power generator, and performs operation processing to select a clock operation mode to obtain the most appropriate power saving state in terms of power consumption, among the several kinds of clock operation states of the rechargeable electronic watch 10.

Consequently, if the power generation amount of the power generation means 1 in the power supply 26 is sufficient, or the remaining capacity of the power storage means 2 in the power supply 26 is sufficient, all clock operation modes provided on the rechargeable electronic watch 10 can be driven, which is one of the clock operation modes of the present invention.

If the power generation amount of the power generation means 1 or the remaining capacity of the power storage means 2 in the power supply 26 has become slightly lower than a predetermined threshold, it is possible to set several kinds of clock operation modes in which a driving operation is stopped of at least one clock operation mode having a low power consumption, selected from all of the clock operation modes provided on the rechargeable electronic watch 10. It is also possible to stop driving operation of at least one clock operation mode having large power consumption, among all of the clock operation modes provided on the rechargeable electronic watch 10.

Similarly, if the power generation amount of the power generation means 1 or the remaining capacity of the power storage means 2 in the power supply 26 has become considerably lower that a predetermined threshold, it is possible to set several kinds of clock operation modes, to stop a plurality of driving operations among a plurality of driving operations different in their power consumption, among all clock operation modes provided on the rechargeable electronic watch 10.

Further, in the present invention, it is also possible to set a clock operation mode in which the power supply 26 can be used as long as possible, or in which a predetermined necessary function can be driven regardless of the current situation of the power generation amount of the power generating means 1 or of the remaining capacity of the power storage means 2, by detecting the amount of the power generation of the power generating means 1 or the amount of remaining capacity of the power storage means 2, both constituting the power supply 26, has been reduced from a predetermined threshold while taking into account the present amount of the power generation of the power generating means 1 or the amount of remaining capacity of the power storage means 2.

The control method of the present invention mentioned above may process the operation automatically, according to a predetermined program, or particularly, as for the operation concerning the additional function, it is possible to modify the clock operation mode so that the power saving operation mode is set by a manual operation of the user.

In the present invention, even if any driving means of the display means 11 and the watch circuit 5 is in the power saving operation mode, the predetermined display information is certainly erased from the display means; however, it is allows the hour information in the rechargeable electronic watch 10 to display the actual hour immediately after the power saving operation mode is cancelled, as the time circuit 6 operates constantly, and its state is always stored in a memory.

For example, by counting the time during which the hour display is suspended by providing a convenient counter, the resumption of the hour display can be realized by providing a fast-forward means, to fast forward the hour and minute hands to the actual hour.

Figure 2:
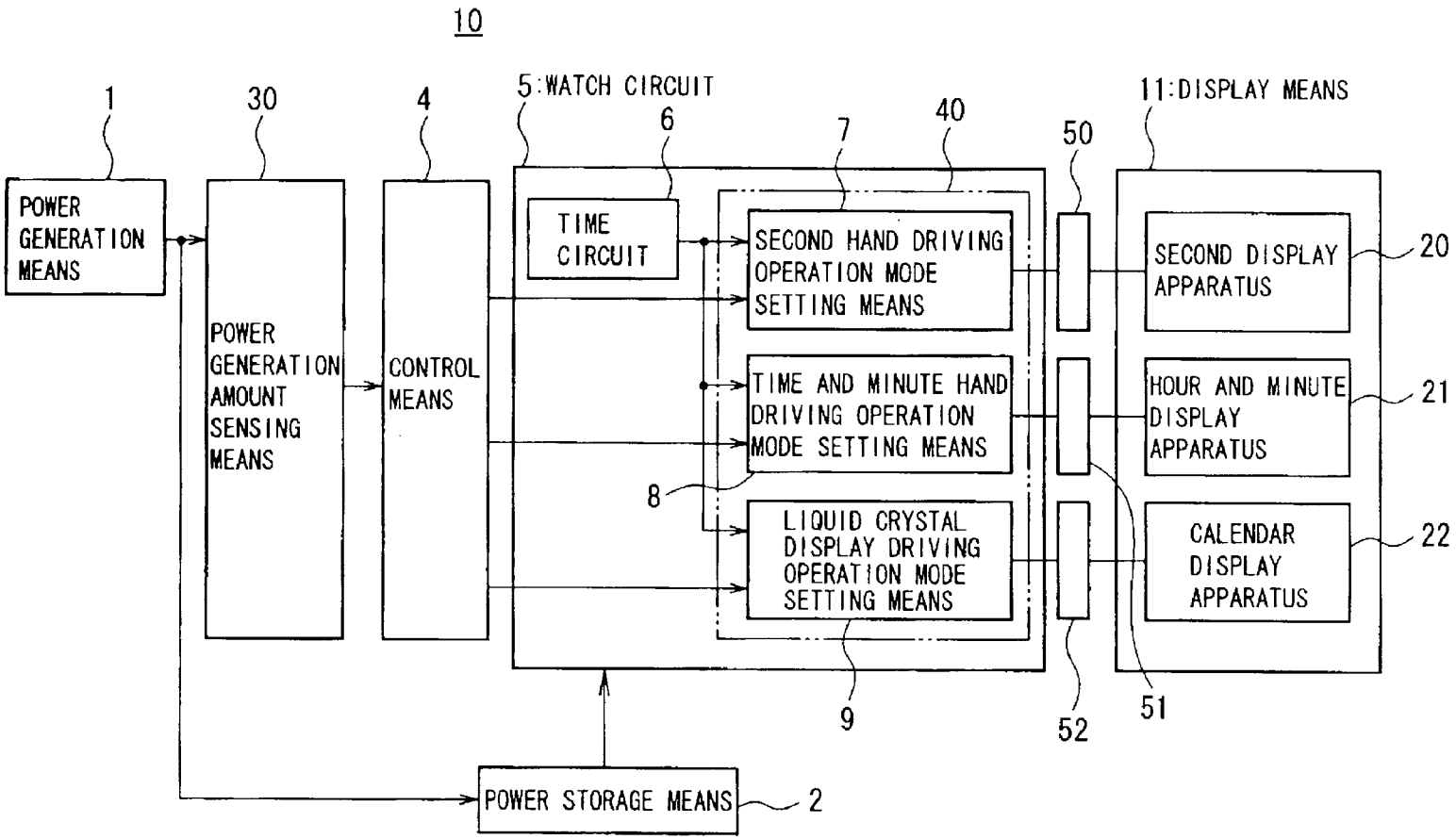
FIG. 2 is a block diagram showing the composition of a first exemplary embodiment of there chargeable electronic watch of the present invention.

The first exemplary embodiment of the present invention, in the block diagram of FIG. 2, is designed to control the control means 4 according to the power generation amount of the power generation means 1 sensed by the power generation amount detecting means 30. Now, an exemplary embodiment of the driving method of the rechargeable electronic watch 10 of the present invention will be described referring to Table 1.

In this exemplary embodiment, the display means 11 of the rechargeable electronic watch 10 comprises a second display 20, an hour and minute display 21 and a calendar display 22, and a second hand motor driving control circuit 50, an hour and minute motor driving control circuit 51, and a calendar display apparatus driving control circuit 52 or the like are disposed between the watch circuit 5 and the display means 11.

Also, it is supposed that, in the display means 11, the power consumption of the calendar display 22 is the largest, the power consumption of the second display 20 is second largest, and the power consumption of the hour and minute display 21 is lowest among the aforementioned three kinds of displays.

In such a situation, the display means 11 is controlled to one of several levels of clock operation modes according to whether the power generation amount of the power generation means 1 sensed by the power generation amount detecting means 3 is equal or lower than a predetermined threshold value, or the power generation amount is equal or above the threshold, and further the degree of the power generation amount.

In this exemplary embodiment, as is apparent from Table 1, the second hand motor driving control circuit 50, the hour and minute motor driving control circuit 51, and the calendar display driving control circuit 52 are activated respectively by a control signal Ea for controlling the liquid crystal display driver driving the calendar display means, a control signal Eb for controlling the driving of the second display, and a control signal Ec for controlling the driving of the hour and minute second display according to the sensed power generation amount from the power generation amount detecting means 3.

In the Table 1, the control signal H indicates an active state.

In other words, if the power generation amount of the power generation means 1 is equal to or lower than a predetermined threshold value, all control signals Ea, Eb, Ec are set to "L" level to stop the display operation of the aforementioned three kinds of displays.

Even in such state, the time circuit 6 of the watch circuit 5 is driven normally.

Next, even when the power generation amount of the power generation means 1 is equal to or above the predetermined threshold value, if its power generation amount is low, only the hour and minute display 21 of which power consumption is the lowest is driven, among the aforementioned three kinds of displays, while the driving of the other displays 20, 22 is set to stop.

On the other hand, when the power generation amount of the power generation means 1 is equal to or above the predetermined threshold value and its power generation amount is relatively high, the hour and minute display 21 of which power consumption is the lowest and the second display 20 requiring the next lowest power consumption are driven, among the aforementioned three kinds of displays, while the driving of the calendar display 22 is set to stop.

Further, when the power generation amount of the power generation means 1 is equal to or above the predetermined threshold value and its power generation amount is considerably high, it is controlled to drive all of the aforementioned three kinds of displays.

This exemplary embodiment adopts an algorithm to drive the displays beginning from the one lowest in power consumption, in response to the increasing degree of the power generation amount of the power generation means 1; however, this order can be modified, and in addition, as mentioned below, it is also possible to stop intentionally a predetermined display and to drive a predetermined display by the user setting.

Now, a second exemplary embodiment of a rechargeable electronic watch and driving method of the present invention will be described in detail referring to FIG. 3 and Table 2.

In this exemplary embodiment, compared to the aforementioned first example, the detecting means is provided with a power generation amount detecting means 3 for detecting the power generation amount of the power generation means 1 and a power storage amount detecting means 31 for detecting the power storage amount flowing into the storage means 2 or a remaining capacity detecting means 32, and it determines the clock operation mode based on both detecting information.

This exemplary embodiment selects an operation mode modifying the combination of displays to be operated respectively, according to the magnitude of the power generation amount and the magnitude of the remaining capacity.

This exemplary embodiment of the rechargeable electronic watch 10 is similar to the exemplary embodiment shown in FIG. 2 except that the power storage amount detecting means 31 or the remaining capacity detecting means 32 are added, the second hand motor driving control circuit 50, the hour and minute motor driving control circuit 51 and the calendar display apparatus driving control circuit 52 are activated respectively by a control signal Ea (liquid crystal display), a control signal Eb (second display), and a control signal Ec (hour and minute second display) from a power generation amount detecting means 30; however, it is controlled to select one of the clock operation modes, selectively setting the second hand motor driving control circuit 50, the hour and minute motor driving control circuit 51, and the calendar display apparatus driving control circuit 52 to an activated state or a non-activated state respectively, as shown in Table 2, by limiting the control signal from the power generation amount detecting means 30 by a control signal Ma controlling the liquid crystal display driver driving the calendar display means, a control signal Mb for controlling the driving of the second display, and a control signal Mc for controlling the driving of the hour and minute second display, by the output from a remaining capacity detecting means 32.

In this exemplary embodiment, a rechargeable electronic watch 10 operating with a power supply 26 including a power generation means 1 and a power storage means 2 charged with electric energy from the power generation means 1, the rechargeable electronic watch 10 comprises a watch circuit 5 for counting or operating hour information or function information or the like and outputting information, a display means 11 for displaying hour information or function information or the like based on an output signal from the watch circuit 5, a power generation amount detecting means 30 for detecting the power generation amount of the power generation means 1, a remaining capacity detecting means 32 for detecting the remaining capacity of the power storage means 2, and a control means 4 for controlling the operation of the watch circuit 5 according to the remaining capacity and the power generation amount, wherein the watch circuit is driven by at least one clock operation mode selected from a plurality of clock operation modes different in power consumption. In the third exemplary embodiment of the present invention, it is also possible to control the control means 4, according to the power generation amount of the power generation means 1 sensed by the power generation amount detecting means 30 and the remaining capacity of the power storage means 2 sensed by the remaining capacity detecting means 31, in the block diagram of FIG. 1.

Figure 4:
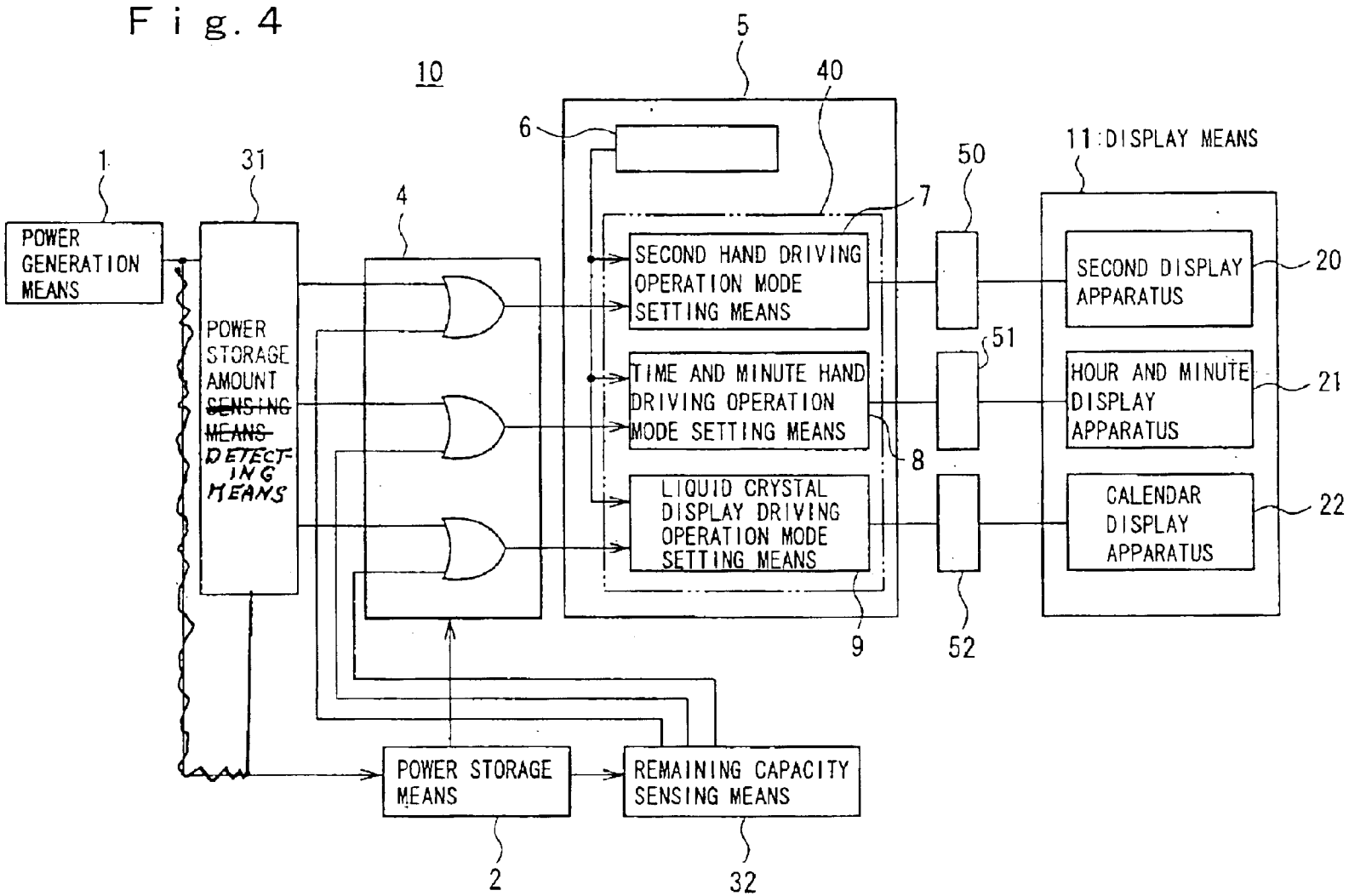
FIG. 4 is a block diagram showing the composition of a fourth exemplary embodiment of the rechargeable electronic watch of the present invention.

In the fourth exemplary embodiment of the present invention, shown in FIG. 4, a rechargeable electronic watch 10 operates with a power supply 26 including a power generation means 1 and a power storage means 2 charged with electric energy from the power generation means 1. The rechargeable electronic watch comprises a watch circuit 5 for counting or operating hour information or function information or the like and outputting information, a display means 11 for displaying hour information or function information or the like based on an output signal from the watch circuit 5, a power storage amount detecting means 31 for detecting the power storage amount into the power storage means 2, a remaining capacity detecting means 32 for detecting the remaining capacity of the power storage means 2, and a control means 4 for controlling the operation of the watch circuit 5 according to the remaining capacity and the power storage amount, wherein the watch circuit is driven by at least one clock operation mode selected from a plurality of clock operation modes different in power consumption provided by the watch circuit 5 based on the control of the control means 5.

An exemplary control algorithm in the control means 4 in the present invention may drive in a clock operation mode of low power consumption, among a plurality of clock operation modes different in power consumption, as the power generation amount of the power generation means 1 becomes lower, or to drive in a clock operation mode of low power consumption, among a plurality of clock operation modes different in power consumption, as the power storage amount of the power storage means 2 becomes lower.

Moreover, in the present invention, it is also possible to drive in a clock operation mode of low power consumption, among a plurality of clock operation modes different in power consumption, as the remaining capacity of the power storage means 2 becomes lower.

Figure 5:
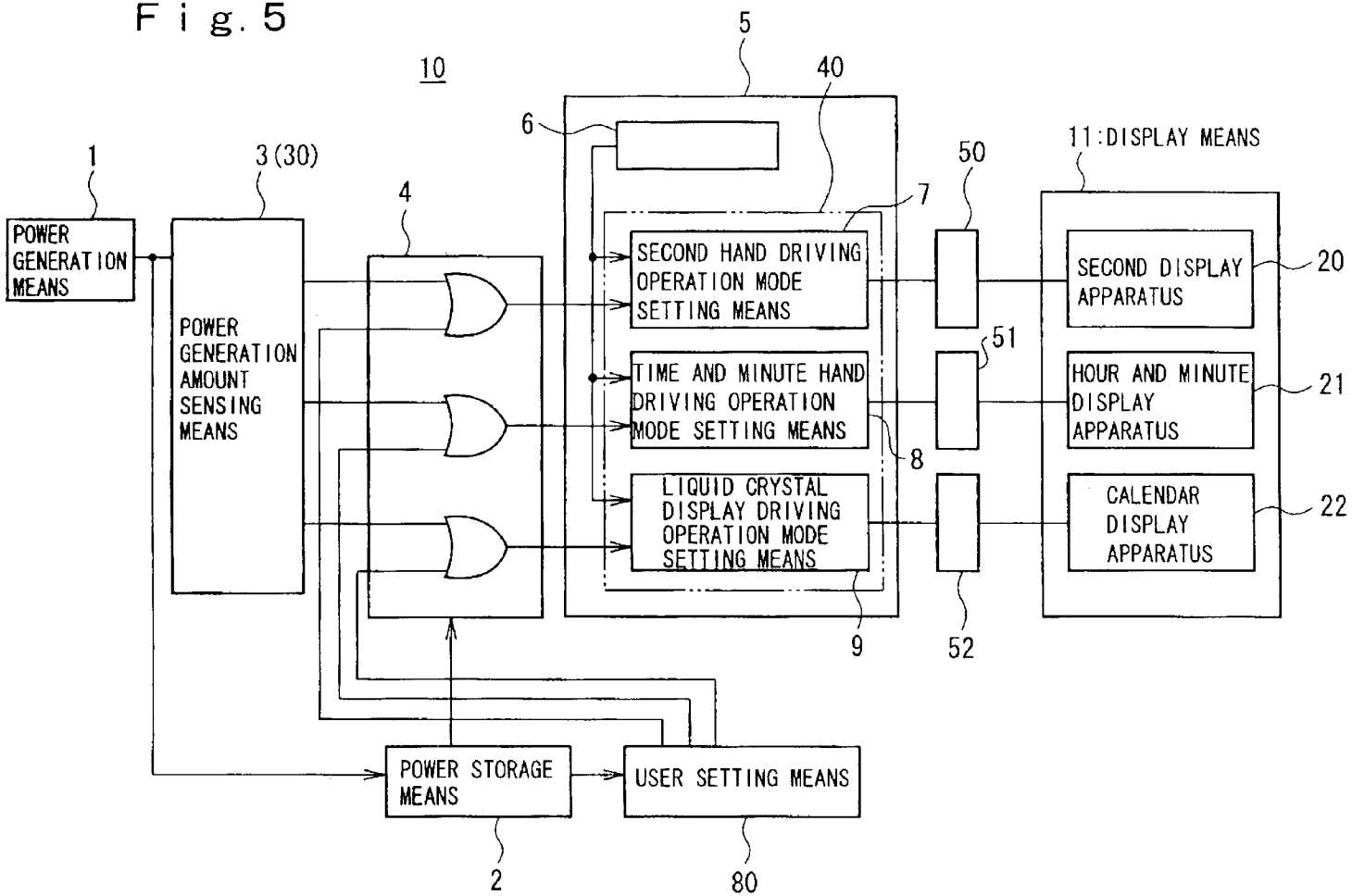
FIG. 5 is a block diagram showing the composition of a fifth exemplary embodiment of there chargeable electronic watch of the present invention.

Now, a fifth exemplary embodiment of the rechargeable electronic watch 10 according to the present invention will be described in detail referring to FIG. 5 and Table 3.

While, the aforementioned exemplary embodiments select one of a plurality of clock operation modes putting some or all of the respective displays in the display means 11 in a driving state or putting all of the respective display apparatuses in a non driving state, according to a predetermined algorithm, based on output information from respective detecting means of power generation amount detecting means 30, power storage amount detecting means 31 or remaining capacity detecting means 32, or the like; however, in this exemplary embodiment, the rechargeable electronic watch 10 is further provided with a user setting means 80 allowing the user to set the clock operation mode, and the control means 4 to drive the watch circuit 5 in a clock operation mode desired by the user, based on the output signal from the user setting means 80, namely, a signal showing that the user has set consciously a predetermined power saving function.

Figure 3:
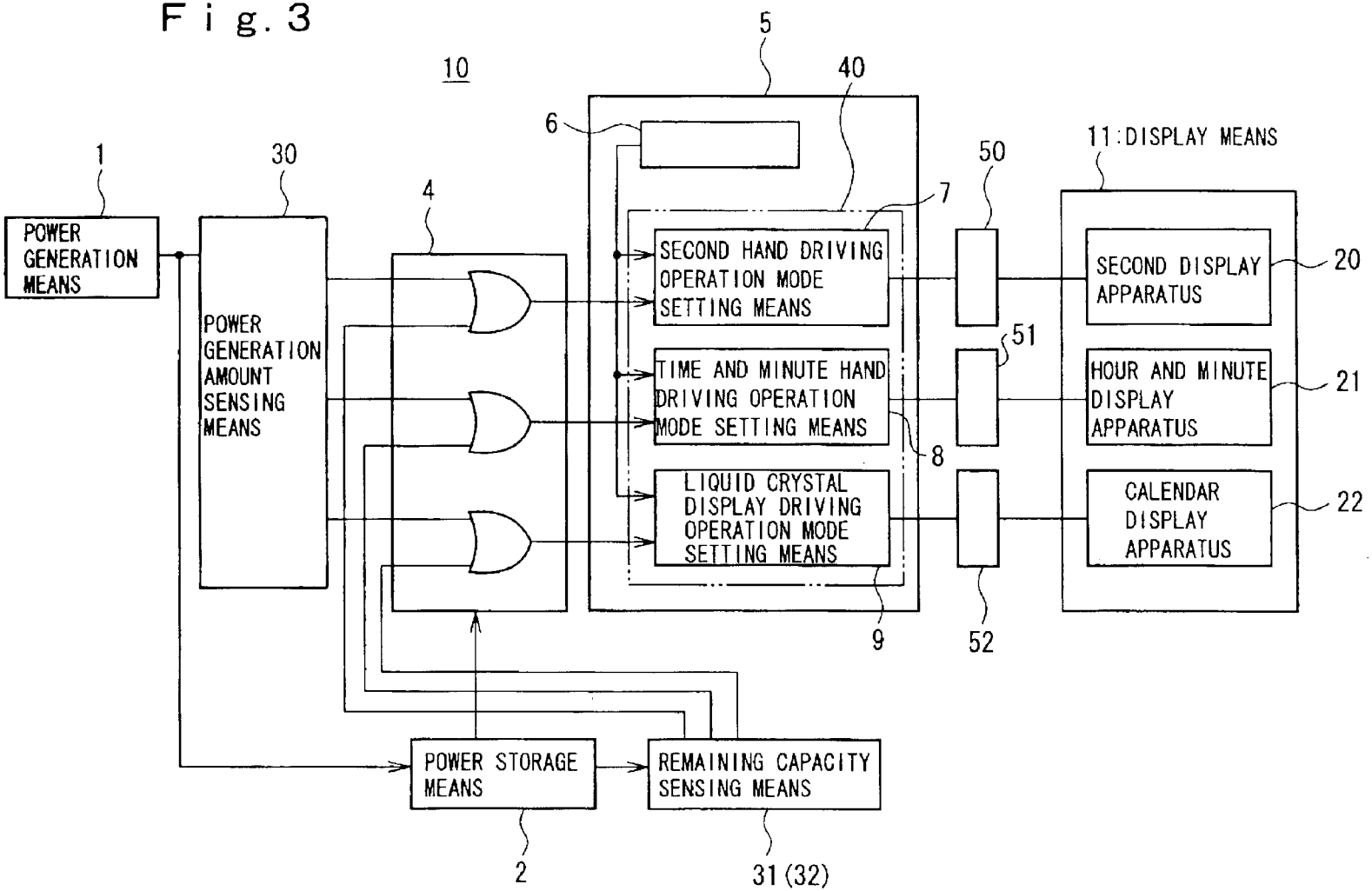
FIG. 3 is a block diagram showing the composition of a second exemplary embodiment of the rechargeable electronic watch of the present invention.

Consequently, the block diagram of this exemplary embodiment is substantially similar to FIG. 3, and has a composition in which the remaining capacity detecting means 32 of FIG. 3 is replaced by the user setting means 80.

In such composition, the second hand motor driving control circuit 50, hour and minute motor driving control circuit 51 and calendar display apparatus driving control circuit 52 are activated respectively by control signals Ea (liquid crystal display) Eb (second display) Ec (hour and minute time display) from the power generation amount detecting means 30; however, the control signal from the power generation amount detecting means 30 is limited by means of control signals Sa (liquid crystal display) Sb (second display) Sc (hour and minute time display) for power saving function setting selected and controlled by the operation setting of the user through the user setting means 80.

The operation signal by the user setting means 80 is, for example, set to (1) always execute all displays; (2) limit only the liquid crystal display according to the power generation amount; (3) limit the liquid crystal and second display according to the power generation amount; and (4) limit the liquid crystal, second display, and the hour and minute display according to the power generation amount.

Control signals and operation modes according to the power generation amount and the user setting are as shown Table 3.

The present invention intends, basically, to extend the use period of time of the rechargeable electronic watch as long as possible without degrading usage, by controlling so that the energy balance of the power generation amount in the power generation means 1 minus the energy consumption by the display means 11 is not negative and, for this effect, it is also necessary to control the energy balance.

In other words, in the present invention, a rechargeable electronic watch operating with an energy source comprising a power supply including a power generation means and a power storage means charged with electric energy from the power generation means, the rechargeable electronic watch comprising a watch circuit for counting or operating hour information or function information or the like and outputting information, a display means for displaying hour information or function information or the like based on output signal from the watch circuit, a power generation amount detecting means for detecting the power generation amount of the power generation means, and a control means for controlling the operation of the watch circuit according to the energy balance of the power generation amount and the clock power consumption amount, wherein the watch circuit is driven in at least one clock operation mode selected from a plurality of clock operation modes different in power consumption provided by the watch circuit based on the control of the control means.

In the rechargeable electronic watch 10 of the exemplary embodiments shown in FIG. 2 to FIG. 5, supposing that power generation amount of the power generation means 1, namely, current generated by the power generation means 1 is IG, current consumption by driving the liquid crystal display means 22 is Ia, current consumption by driving the second display motor of the second display means 20 is Ib, current consumption by driving the hour and minute display motor of the hour and minute display means 21 is Ic, and current consumption by oscillator, counter circuit or the like other than the respective display apparatuses in the watch circuit 5 is Iz, the operation mode control based on the energy balance corresponding to the magnitude of the power generation amount and the magnitude of the power consumption of the respective apparatus gives a relation as shown in Table 4.

In Table 4, if a system is designed to select the state marked with *1, the balance will not be negative even when the power generation is minimum (or null), but the time will be wrong.

In the exemplary embodiment, it is also possible to design a rechargeable electronic watch operating with an energy source comprising a power supply including a power generation means and a power storage means charged with electric energy from the power generation means, the rechargeable electronic watch comprising a watch circuit for counting or operating hour information or function information or the like and outputting information, a display means for displaying hour information or function information or the like based on output signal from the watch circuit, a power storage amount detecting means for detecting the power storage amount flowing into the power storage means, and a control means for controlling the operation of the watch circuit according to the energy balance of the power storage amount and the power consumption amount of the rechargeable electronic watch, wherein the watch circuit is driven by at least one clock operation mode selected from a plurality of clock operation modes different in power consumption provided by the watch circuit based on the control of the control means, and moreover, it is also possible to design a rechargeable electronic watch operating with an energy source comprising a power supply including a power generation means and a power storage means charged with electric energy from the power generation means, the rechargeable electronic watch comprising a watch circuit for counting or operating hour information or function information or the like and outputting information, a display means for displaying hour information or function information or the like based on output signal from the watch circuit, a power generation amount detecting means for detecting the power generation amount of the power generation means, a remaining capacity detecting means for detecting the remaining capacity of the accumulation means and a control means for controlling the operation of the watch circuit according to the energy balance of the remaining capacity, the power generation amount and the power consumption amount of the clock, wherein the watch circuit is driven by at least one clock operation mode selected from a plurality of clock operation modes different in power consumption provided by the watch circuit based on the control of the control means.

Further, it is possible to compose a rechargeable electronic watch 10 operating with an energy source comprising a power supply including a power generation means and a power storage means charged with electric energy from the power generation means, the rechargeable electronic watch comprising a watch circuit for counting or operating hour information or function information or the like and outputting information, a display means for displaying hour information or function information or the like based on output signal from the watch circuit, a power storage amount detecting means for detecting the power storage amount flowing into the power storage means, a remaining capacity detecting means for detecting the remaining capacity of the accumulation means and a control means for controlling the operation of the watch circuit according to the energy balance of the remaining capacity, the power storage amount and the power consumption amount of the clock, wherein the watch circuit is driven by at least one clock operation mode selected from a plurality of clock operation modes different in power consumption provided by the watch circuit based on the control of the control means, and it is also possible to use a power storage amount detecting means for detecting the power storage amount flowing to the accumulation means, a power storage amount detecting means for detecting the power storage amount into the power storage means, and a control means for controlling the operation of the watch circuit according to the energy balance of the power generation amount, the power storage amount and the power consumption amount of the clock, wherein the watch circuit is driven by at least one clock operation mode selected from a plurality of clock operation modes different in power consumption provided by the watch circuit based on the control of the control means.

As mentioned above, the control means according to the present invention is preferably designed to control to drive in a predetermined clock operation mode among a plurality of clock operation modes different in power consumption so that the energy balance is not negative.

In other words, the clock operation mode is the one to stop at least a part of the display means, and the display means may be a hand, or the display means may be a digital display.

Briefly, the rechargeable electronic watch 10 according to the present invention is a rechargeable electronic watch operating with an energy source comprising a power supply including a power generation means and a power storage means charged with electric energy from the power generation means, wherein the watch circuit is driven by at least one clock operation mode selected from a plurality of clock operation modes different in power consumption provided by the watch circuit based on the control of the control means.

In the exemplary embodiment of the present invention, the operation modes provided by the user setting means by the user setting, namely the power saving means selected by the user setting are shown taking the relations shown in Table 3 as an example; however, alternative embodiments as shown below can be designed.

Namely, (1) not to inhibit display in any use state (user preference).

(2) Compel to display by pressing a button or the like, when the liquid crystal display is inhibited, under low power generation (for instance, when a rechargeable electronic watch driven by a solar cell is put in the dark).

(3) Set not to inhibit the alarm operation under any power generation amount.

(4) Inhibit to start the chronometric operation under low power generation under, but not to inhibit the chronometric operation, once the same has started.

Concerning the setting of the user setting means in this exemplary embodiment, for instance, 1) regular setting (once set, valid until cancellation)

2) temporary setting (valid only while the button is pressed) states can be designed.

Also, in the power generation amount detecting means 30 according to the present invention, for instance, the following cases can be envisioned concerning the detecting timing of the power generation amount detecting means 30, power generation amount level judgment, respective mode transition control according to the power generation amount, 1) confirm the clock operation mode based on the actual power generation amount, if a state of a certain level of power generation has continued for a fixed period of time or more.

Such operation can limit the instant response to the power generation amount detecting, namely, inhibit an immediate transition to the power saving mode upon a momentary variation of power generation amount (for instance, when sunlight incident to a solar cell is shielded instantaneously by a sleeve).

2) The power generation amount level is judged by an integral value over a fixed time.

Such operation can limit the instantaneous response to the power generation amount detecting for the same reason as 1), and increase the operation accuracy, in the balance judgment.

3) Sense the power generation amount intermittently. Such operation reduces the current consumption of the power generation detecting itself.

4) Confirm the actual power generation amount, if a state in which the power generation amount sensed in 3) is of certain level continuously equal or superior to a fixed number of times.

Such operation can limit the instantaneous response to the power generation amount detecting, and consequently, inhibit an immediate transition to the power saving mode upon a momentary variation of power generation amount (for instance, when sunlight incident to a solar cell is shielded instantaneously by a sleeve).

5) The transition between modes according to the power generation amount can be differentiated for the reducing power generation amount and for the increasing power generation amount. Namely, continuous detecting time or number of times required for level transition can be differentiated by the mode transition direction.

The feeling of usage by the user can be improved, by making it difficult to transit to the mode in the direction to limit the function, and easier to transit to the mode in the direction to cancel the function limitation. In other words, it becomes possible to not limit the function needlessly, and to cancel the function limitation promptly.

Another embodiment of the present invention is a driving method of a rechargeable electronic watch operating with an energy source comprising a power supply including a power generation means and a power storage means charged with electric energy from the power generation means, wherein the watch circuit is driven in at least one clock operation mode selected from a plurality of clock operation modes different in power consumption provided by the watch circuit, according to the power storage amount of the power storage means.

Another exemplary embodiment of the present invention is a driving method of a rechargeable electronic watch operating with an energy source comprising a power supply including a power generation means and a power storage means charged with electric energy from the power generation means, wherein the watch circuit is driven by at least one clock operation mode selected from a plurality of clock operation modes different in power consumption provided by the watch circuit, according to the remaining capacity detecting means for detecting the remaining capacity of the power storage means, and the power generation amount of the power generation means.

Still another exemplary embodiment of the present invention is a driving method of a rechargeable electronic watch operating with an energy source comprising a power supply including a power generation means and a power storage means charged with electric energy from the power generation means, wherein the watch circuit is driven by at least one clock operation mode selected from a plurality of clock operation modes different in power consumption provided by the watch circuit, according to the remaining capacity detecting means for detecting the remaining capacity of the power storage means, and the power storage amount into the power storage means.

The rechargeable electronic watch and the driving method of the rechargeable electronic watch according to the present invention, adopting the technical approach mentioned above, is designed to optimize the electric power balance, by selecting conveniently a clock operation mode according to the power generation amount of the power generation means and the power storage amount into the power storage means, in an ordinary rechargeable electronic watch displaying hour information or a multi-function type rechargeable electronic watch equipped with multiple functions providing many kinds of additional function information and, as a result, it becomes possible to extend the clock operation duration of the rechargeable electronic watch, and to provide a rechargeable electronic watch that would not adversely affect the feeling of usage of the rechargeable electronic watch, by limiting the limitation of functions by the user to a strict minimum.

TABLE 1

| POWER GENERATION AMOUNT | CONTROL SIGNAL Ea | Eb | Ec | OPERATION MODE |
|---|---|---|---|---|
| HIGH | H | H | H | CALENDAR DISPLAY + SECOND DISPLAY + HOUR AND MINUTE DISPLAY |
| \| | | | | |
| \| | | | | |
| \| | L | H | H | SECOND DISPLAY + HOUR AND MINUTE DISPLAY |
| \| | | | | |
| \| | L | L | H | HOUR AND MINUTE DISPLAY |
| LOW | L | L | L | NO DISPLAY |

TABLE 2

| POWER GENERATION AMOUNT | CONTROL SIGNAL BECOMING H | REMAINING CAPACITY HIGH----------LOW Ma, Mb, Mc | Mb, Mc | Mc | NONE |
|---|---|---|---|---|---|
| HIGH | Ea, Eb, Ec | LC + SEC + H/MIN | LC + SEC + H/MIN | LC + SEC + H/MIN | LC + SEC + H/MIN |
| \| | | | | | |
| \| | Eb, Ec | LC + SEC + H/MIN | SEC + H/MIN | SEC + H/MIN | SEC + H/MIN |
| \| | | | | | |
| \| | Ec | LC + SEC + H/MIN | SEC + H/MIN | HOUR/MIN | HOUR/MIN |
| \| | | | | | |
| LOW | NONE | LC + SEC + H/MIN | SEC + H/MIN | HOUR/MIN | NONE |

TABLE 3

| POWER GENERATION AMOUNT | CONTROL SIGNAL BECOMING H | USER SETTING STATE ALWAYS DISPLAY ALL Ma, Mb, Mc | LIMIT LIQUID CRYSTAL DISPLAY ACCORDING TO POWER GENERATION AMOUNT Sa Mb, Mc | LIMIT LIQUID CRYSTAL AND SECOND ACCORDING TO POWER GENERATION AMOUNT Sa, Sb Mc | LIMIT LIQUID CRYSTAL SECOND HOUR/MIN DISPLAY ACCORDING TO POWER GENERATION AMOUNT Sa, Sb, Sc NONE |
|---|---|---|---|---|---|
| HIGH | Ea, Eb, Ec | LC + SEC + H/MIN | LC + SEC + H/MIN | LC + SEC + H/MIN | LC + SEC + H/MIN |
| \| | Eb, Ec | LC + SEC + H/MIN | SEC + H/MIN | SEC + H/MIN | SEC + H/MIN |
| \| | Ec | LC + SEC + H/MIN | SEC + H/MIN | HOUR/MIN | HOUR/MIN |
| LOW | NONE | LC + SEC + H/MIN | SEC + H/MIN | HOUR/MIN | NONE |

TABLE 4

| POWER GENERATION AMOUNT | BALANCE RELATION | OPERATION MODE |
|---|---|---|
| HIGH | IG ≧ Ia + Ib + Ic + Iz | LC DISPLAY + SECOND DRIVE + H/MIN DRIVE + CLOCK CIRCUIT |
| \| | Ia + Ib + Ic + Iz > IG ≧ Ib + Ic + Iz | SECOND DRIVE + H/MIN DRIVE + CLOCK CIRCUIT |
| \| | Ib + Ic + Iz > IG ≧ Ic + Iz | HOUR/MIN DRIVE + CLOCK CIRCUIT |
| \| | Ic + Iz > IG ≧ Iz | CLOCK CIRCUIT |
| LOW | Iz > IG | STOP ALL CIRCUITS |

What is claimed is:

1. A rechargeable electronic watch operating with an energy source comprising a power supply including a power generation means and a power storage means charged with electric energy generated from said power generation means, said rechargeable electronic watch comprising a watch circuit for counting or processing time information or function information so as to output said information, a display means for displaying said time information or said function information based on an output signal from said watch circuit, a power storage amount detecting means for detecting an amount of power flowing into in said power storage means, a remaining capacity detecting means for detecting the remaining capacity of said power storage means, and a control means for controlling the operation of said watch circuit in response to said remaining capacity and said amount of said power storage, wherein said watch circuit is driven in at least one clock operation mode selected, based on the control of said control means, from a plurality of clock operation modes provided in said rechargeable electronic watch, each of said modes being different from each other in power consumption.

2. The rechargeable electronic watch according to claim 1, wherein the lower said amount of said power storage, said electronic watch is controlled to be driven under a clock operation mode whereby said electronic watch can be driven with the lessen power consumption and selected from a plurality of clock operation modes each being different from each other, in power consumption.

3. The rechargeable electronic watch according to claim 1, wherein the lower said remaining capacity, said electronic watch is controlled to be driven under a clock operation mode whereby said electronic watch can be driven with the lesser power consumption and selected from a plurality of clock operation modes each being different from each other, in power consumption.

4. A rechargeable electronic watch operating with an energy source comprising a power supply including a power generation means and a power storage means charged with electric energy generated from said power generation means, said rechargeable electronic watch comprising a watch circuit for counting or processing time information or function information so as to output said information, a display means for displaying said time information or said function information based on an output signal from said watch circuit, a power generation amount detecting means for detecting an amount of said power generation of said power generation means, and a control means for controlling the operation of said watch circuit in response to an energy balance of said amount of said power generation and an amount of the power consumption of the rechargeable electronic watch, wherein said watch circuits driven in at least one clock operation mode selected, based on the control of said control means from a plurality of clock operation modes provided in said rechargeable electronic watch, each of said modes being different from each other in power consumption.

5. A rechargeable electronic watch operating with an energy source comprising a power supply including a power generation means and a power storage means charged with electric energy generated from said power generation means, said rechargeable electronic watch comprising a watch circuit for counting or processing time information or function information so as to output said information, a display means for displaying said time information or said function information based on an output signal from said watch circuit, a power storage amount detecting means for detecting an amount of power flowing into said power storage means and a control means for controlling the operation of said watch circuit in response to an energy balance of said amount of said power storage and an amount of the power consumption of the rechargeable electronic watch, wherein said watch circuit is driven in at least one clock operation mode selected, based on the control of said control means, from a plurality of clock operation modes provided in said rechargeable electronic watch each of said modes being different from each other in power consumption.

6. A rechargeable electronic watch operating with an energy source comprising a power supply including a power generation means and a power storage means charged with electric energy generated from said power generation means, said rechargeable electronic watch comprising a watch circuit for counting or processing time information or function information so as to output said information, a display means for displaying said time information or said function information based on an output signal from said watch circuit, a power generation amount detecting means for detecting an amount of said power generation of said power generation means, a remaining capacity detecting means for detecting the remaining capacity of said power storage means and a control means for controlling the operation of said watch circuit in response to an energy balance of said amount of said power generation and an amount of said remaining capacity and an amount of the power consumption of the rechargeable electronic watch, wherein said watch circuit is driven in at least one clock operation mode selected based on the control of said control means, from a plurality of clock operation modes provided in said rechargeable electronic watch, each of said modes being different from each other in power consumption.

7. A rechargeable electronic watch operating with an energy source comprising a power supply including a power generation means and a power storage means charged with electric energy generated from said power generation means, said rechargeable electronic watch comprising a watch circuit for counting or processing time information or function information so as to output said information, a display means for displaying said time information or said function information based on an output signal from said watch circuit, a power storage amount detecting means for detecting an amount of power flowing into said power storage means, a remaining capacity detecting means for detecting the remaining capacity of said power storage means and a control means for controlling the operation of said watch circuit in response to an energy balance of said amount of said power storage and an amount of said remaining capacity and an amount of the power consumption of the rechargeable electronic watch, wherein said watch circuit is driven in at least one clock operation mode selected, based on the control of said control means, from a plurality of clock operation modes provided in said rechargeable electronic, each of said modes being different from each other in power consumption.

8. The rechargeable electronic watch operating with an energy source comprising a power supply including a power generation means and a power storage means charged with electric energy generated from said power generation means, said rechargeable electronic watch comprising a watch circuit for counting or processing time information or function information so as to output said information, a display means for displaying said time information or said function information based on an output signal from said watch circuit, a power generation amount detecting means for detecting an amount of said power generation of said power generation means, a power storage amount detecting means for detecting an amount of power flowing into said power storage means, and a control means for controlling the operation of said watch circuit in response to an energy balance of said amount of said power storage and an amount of said power generation and an amount of the power consumption of the rechargeable electronic watch, wherein said watch circuit is driven in at least one clock operation mode selected, based on the control of said control means, from a plurality of clock operation modes provided in said rechargeable electronic watch, each of said modes being different from each other in power consumption.

9. The rechargeable electronic watch according to any one of claims 4 to 8, wherein said control means drives said electronic watch at a predetermined clock operation mode selected from a plurality of clock operation modes each being different from each other, in power consumption, so that said energy balance may not be negative.

10. The rechargeable electronic watch according to any one of claim 1, or 4 to 8 wherein under said clock operation mode, at least a part of said display means is stopped.

11. The rechargeable electronic watch according to any one of claim 1, or 4 to 8, wherein said electronic watch further comprising an user setting means allowing the user to set said clock operation mode, wherein said control means drives the watch circuit at the user's desired clock operation mode, based on an output signal from said user setting means.

12. A driving method of a rechargeable electronic watch operating with an energy source comprising a power supply including a power generation means and a power storage means charged with electric energy generated from said power generation means, wherein said rechargeable electronic watch is driven in at least one clock operation mode selected from a plurality of clock operation modes provided in said rechargeable electronic watch, each of said modes being different from each other in power consumption, in response to a remaining capacity of said power storage means detected by a remaining capacity detecting means and said amount of said power generation of said power generation means.

13. A driving method of a rechargeable electronic watch operating with an energy source comprising a power supply including a power generation means and a power storage means charged with electric energy generated from said power generation means, wherein said rechargeable electronic watch is driven in at least one clock operation mode selected from a plurality of clock operation modes provided in said rechargeable electronic watch, each of said modes being different from each other in power consumption in response to a remaining capacity of said power storage means detected by a remaining capacity detecting means and an amount of power storage flowing into said power storage means.

* * * * *